US005887311A

United States Patent [19]

Kresse et al.

[11] Patent Number: 5,887,311

[45] Date of Patent: Mar. 30, 1999

[54] FLAT MOP HEAD FOR CLEANING FLOORS

[75] Inventors: Franz Kresse, Hilden; Rainer Osberghaus, Duesseldorf, both of Germany

[73] Assignee: Henkel-Ecolab GmbH & Co. OHG, Duesseldorf, Germany

[21] Appl. No.: 836,086

[22] PCT Filed: Oct. 18, 1995

[86] PCT No.: PCT/EP95/04093

§ 371 Date: Apr. 25, 1997

§ 102(e) Date: Apr. 25, 1997

[87] PCT Pub. No.: WO96/13192

PCT Pub. Date: May 9, 1996

[30] Foreign Application Priority Data

Oct. 26, 1994 [DE] Germany ..... 44 38 172.7
Mar. 24, 1995 [DE] Germany ..... 195 10 824.8

[51] Int. Cl.[6] ..... A47L 13/20

[52] U.S. Cl. ..... 15/228; 15/229.4; 15/229.8

[58] Field of Search ..... 15/118, 228, 229.1–229.9

[56] References Cited

U.S. PATENT DOCUMENTS

| | | | |
|---|---|---|---|
| 3,761,991 | 10/1973 | Moss | 15/228 X |
| 4,426,417 | 1/1984 | Meitner et al. | 428/195 |
| 4,961,242 | 10/1990 | Kresse et al. | 15/228 |
| 5,066,527 | 11/1991 | Newell | 428/35.6 |
| 5,397,622 | 3/1995 | Thomas | 428/192 |

FOREIGN PATENT DOCUMENTS

| | | | |
|---|---|---|---|
| 1 109 654 | 9/1981 | Canada . | |
| 0 250 429 | 1/1988 | European Pat. Off. . | |
| 2 406 687 | 5/1979 | France . | |
| 28 27 909 | 1/1980 | Germany . | |
| 29 34 009 | 3/1980 | Germany . | |
| 32 26 947 | 4/1984 | Germany . | |
| 38 09 279 | 7/1989 | Germany . | |
| 91 06 415 | 1/1992 | Germany . | |
| 93 01 615 | 5/1993 | Germany . | |
| 94 02 509 | 5/1994 | Germany . | |
| 93 13 981 | 6/1994 | Germany . | |
| 43 41 263 | 6/1995 | Germany . | |
| 736847 | 9/1955 | United Kingdom | 15/229.4 |
| WO 86/05082 | 9/1986 | WIPO . | |
| 94/236634 | 10/1994 | WIPO . | |
| WO 95/22277 | 8/1995 | WIPO . | |

*Primary Examiner*—Mark Spisich
*Attorney, Agent, or Firm*—Ernest G. Szoke; Wayne C. Jaeschke; Kenneth Watov

[57] ABSTRACT

A flat mop head for cleaning floors includes a cover panel with structure fastening on its top surface and a highly absorbent material at least partially made of cotton and/or viscose in the central area of its bottom surface. At least the longitudinal sides of the cover panel are provided with a hem. A textile rim both at least partially surrounds the edges of the cover panel, and forms the hem. The cover panel consists of at least partially mixed yarns made of synthetic and natural fibers. This wash-resistant cover panel is inexpensive to produce, may be used both for wet and dry cleaning tasks, slides easily on the floor, and has high cleaning power both for water-soluble and solid soil.

20 Claims, 1 Drawing Sheet

FLAT MOP HEAD FOR CLEANING FLOORS

BACKGROUND

1. Field of the Invention

This invention relates generally to mop heads for cleaning floors, and more particulary to flat mop heads.

2. Discussion of Related Art

Numerous flat mop heads for cleaning floors are already known. The present invention relates in particular to wet mop heads, i.e. to mop heads suitable for the moist or wet cleaning of floors. These mop heads are expected to meet a number of requirements. They are expected to take up the cleaning liquid quickly, to transport it without dripping to the floor, to transfer it gradually to the floor and to take up the soiled cleaning liquid, the so-called dirty water, quickly. In addition, they are expected to take up a large amount of solid soil particles, to give off very little fluff and to glide easily over the floor. Since the mop heads are periodically washed at relatively high temperatures, they are also expected to be highly resistant to washing. Finally, the mop heads are expected to be inexpensive to make.

The cleaning-active side, i.e. the underneath of the cover panel, may consist of strands, loops, strips or tufts made of rayon, cotton, manmade fibers and blends thereof in various ratios. The wide range of flat mop heads available is explained by the large number of different requirements which, in general, cannot be optimally satisfied at the same time. If the cleaning-active side, i.e. the bottom of the cover panel, consists of strands, the cleaning performance of the mop head is high, but fluff is given off in large amounts and gliding behavior is poor. If mop heads with loops instead of strands are used, gliding behavior improves and less fluff is given off, but cleaning performance falls to an average level. If, on the other hand, the bottom of the cover panel consists of a sponge cloth or nonwoven material in the form of several strips arranged in rows adjacent one another, hardly any fluff is given off and cleaning performance is very high. Unfortunately, the gliding behavior of the mop head over the floor to be cleaned is poor. Strips such as these on the underneath of the cover panel are described, for example, in DE 38 09 279 C1.

The type of fibers used for the bottom of the cover panel also influences the cleaning result and the life of the mop heads. Although high absorbency is achieved with rayon, this material is unsuitable for frequent washing at relatively high temperatures. Although cotton is more stable to washing than rayon, its absorption capacity is lower. Particularly high resistance to washing and hence a very long useful life are achieved with the bottom of the cover panel being made of manmade fibers. Unfortunately, a mop head of manmade fibers has no absorption capacity.

For these reasons, a mop head according to DE 32 26 947 A1 has proved to be particularly suitable for practice. The mop head has two regions differing in the form of their textile covering. The middle region of the lower surface of the cover panel contains loops of a blend of manmade fibers and cotton. They are intended to take up the dirty water and soil dissolved therein. In addition, an encircling textile border of strands with open yarn ends which also consist of a blend of manmade fibers and cotton is arranged around the edges of the mop head. The strands are intended to take up solid soil particles by the so-called figure-of-eight wiping process in which only one of the two longer sides of the rectangular mop head is always to the front. A further increase in cleaning performance and useful life and a reduction in manufacturing costs would be of advantage.

The production of a flat mop head of the type described in DE 32 26 947 A1 is complicated. The cover panel, which is cut to size, has to be edged with binding to stop the edges of the cover panel from fraying. The binding is woven from polyamide and polyester, i.e. solely from manmade fibers. An encircling textile border of loops or strands with open yam ends is additionally attached to the binding. The provision of insertion pockets on the upper surface and of loops or strands on the bottom of the cover panel completes the production of the mop head. The prefabrication and attachment of the encircling textile border of loops or strands are particularly complicated aspects of the production of the flat mop head.

Mop heads without an encircling textile border are also known. Thus, the flat mop head according to DE 93 01 615 U consists entirely of a relatively thick so-called microfiber cloth. The microfiber cloth cleans very effectively and, according to the data disclosed in this document (page 2, line 1), has an extremely high water absorption capacity. However, the high water absorption capacity mentioned is difficult to comprehend in the light of the standard definition—also employed in this application—of the term "microfiber" which characterizes "microfibers" by a fineness of less than 1 dtex. In other words, 10,000 m of fibers weigh less than 1 g. Fibers as fine as these can consist not only of natural materials, they may also be made of synthetic materials, for example polyester. In view of their extremely smooth fiber surface and their hydrophobic properties, microfibers are definitely not capable of absorbing and binding water. Accordingly, mop heads consisting entirely of microfibers are not suitable for wet cleaning.

Another disadvantage of the mop head known from DE 93 01 615 U is the large amount of very expensive microfiber material required.

Another flat mop head consisting of a microfiber cloth is known from DE 29 34 009 A1. It is not reusable and cannot be washed. The known cloth is intended for the dry cleaning of smooth hard surfaces, i.e. for removing dust. The microfiber cloth in question is at most 1 mm thick random laid nonwoven fabric of microfibers with differently embossed regions to improve the dust uptake capacity of the cloth and to ensure an adequate useful life. It is not suitable for the wet or moist cleaning of floors.

A reusable mop head for a holder of a floor mop known from EP 0 250 429 B1 consists of a cleaning-active bottom of different regions extending stripwise across its length. These regions are formed by cotton fibers partly crocheted into a cover panel consisting of crocheted synthetic fibers. Between the strips of cotton fibers, the bottom surface of the cover panel is bare. The cotton loops are limited in their cleaning performance and, because they are closed, have a smaller effective overall surface than open strands, for example, and hence a reduced spontaneous absorption capacity and a limited soil uptake capacity.

The wet cleaning head according to DE 91 06 415 U1 is also a mop head of a floor mop with different strip-like regions on the bottom of the cover panel. The bottom consists mainly of a cotton terry cloth interrupted by strips which run parallel to the longitudinal axis of the mop head and between which the bottom of the cover panel is bare. The bottom of the cover panel also consists of cotton. This wet mop head has only the moderate cleaning performance typical of cotton and is not abrasive towards obstinate soil.

Another mop head intended for mounting on a baseplate held on a handle is described in DE 28 27 909 C2. A longitudinal strip of an absorbent layer, for example a fleece or a sponge, extends substantially over the middle portion of the bottom surface. Adjoining strips of an abrasive random laid nonwoven, material for example of manmade fibers or metal filaments, are provided at the longitudinal edges. The three strips are sewn onto a cover panel. A disadvantage attending the production of this known mop head is that a binding has to be provided for the cutout cover panel consisting, for example, of a woven fabric and the strips of the random laid nonwoven material have to be subsequently sewn on. An improvement in the production process would lie in a reduction in the number of steps involved.

SUMMARY OF THE INVENTION

The problem addressed by the present invention is to provide a flat mop head which is suitable both for dry and for wet/moist cleaning, which can be produced inexpensively in a small number of steps and which, in addition to good gliding behavior, i.e. minimal friction on the floor, has a particularly high cleaning performance both for water-soluble soil and for solid soil and a long useful life, i.e. high stability to washing.

According to the invention, the solution to this problem is characterized in that the textile border is formed by the binding which extends on the bottom of the cover panel towards the middle thereof over a distance corresponding to at least one sixth of the width of the cover panel and which consists at least partly and, preferably, completely of blended yarns of synthetic and natural fibers. Accordingly, the textile border also acts as a binding.

Tests have shown that a textile material in the form of loops, strands, tufts or strips extending from the edge of the cover panel is not necessary for keeping the solid soil particles in the mop head. A textile border in the form of a binding of the blended yams mentioned performs this function at least as well. The particular advantage lies in the lower production costs. This is because, in the production of the mop head, the cover panel is cut to the required size from wide rolls and the outer edge always has to be bordered or faced with bias binding. According to the invention, the edge can be faced and the textile border applied in a single operation. Although, therefore, strips performing different cleaning functions are provided on the bottom of the cover panel, there is still no need for an additional production step in relation to a flat mop head without an encircling textile border. The binding required in any case for the cover panel performs this function. To this end, it extends on the bottom of the cover panel towards the middle thereof over a distance corresponding to at least one sixth of the width of the cover panel.

The second important advantage lies in the properties of the textile border thus formed. Since the binding consists atleast partly and, preferably, completely of blended yarns of synthetic and natural fibers, the combined effect of the cleaning properties of both fibers shows itself. The synthetic fiber component leads to an abrasive effect on soil adhering obstinately to the floor. The detached soil is quickly taken up by the natural fibers with their typical surfaces characterized by depressions and voids. The blended yarn provided at the edges of the bottom of the mop head additionally has the advantageous effect that the soil particles adhering firmly to the floor are retained by the natural fibers immediately after their removal, and remain at the same position in the fibers so that no soil particles pass to the middle of the bottom of the cover panel which is intended to take up or absorb liquid. Soiling of the middle portion of the bottom is thus reduced to a minimum. Accordingly, the mop head can be washed or wrung out less frequently.

The performance properties of the flat mop head according to the invention differ from those of the mop head according to DE 32 26 947 A1 in two critical respects. Firstly, the textile border formed by the binding is much more stable to washing than the strand material of cotton. Secondly, the textile border consisting of the blended yams has a particularly good cleaning effect on solid soil particles which is far better than that of the encircling cotton strands of the known wet mop head. Although the textile border does not absorb liquid or detached soil and is thus hardly able to take up liquid soil, this problem is solved by the absorbent middle part of the bottom of the cover panel. Accordingly, the apparent disadvantage of the poor absorption capacity of the blended yarns is adequately offset by the absorbent bottom portion of the cover panel. Overall, the performance properties of the flat mop head according to the invention are thus considerably better than those of the known mop heads with encircling loop or strand borders. Another advantage of the blended yarns is that the soil taken up is readily removed under running water or in wash baths.

Another advantage of the present invention is that the blended yarns are located in that part of the mop head which is the first to come into contact with the floor soil, i.e. at the wiping edge. It is also important that the absorbent textile lies behind the blended yarns in the wiping direction because its function is inter alia to dry the cleaned, still wet floor.

According to the invention, fibers of various types may be used as the synthetic fiber component of the blended yarn. The abrasive effect on firmly adhering soil particles is important. In one particularly advantageous embodiment, the synthetic fiber component of the blended yarn consists of polyester. Although polyester fibers have a poor soil retention capacity, their abrasive effect is excellent. As mentioned above, the function of retaining the detached soil is performed by the natural fiber component.

To support the function performed by the natural fibers of retaining the detached soil, fibers which are capable of retaining the detached soil in addition to developing a good abrasive effect may also be used as synthetic fibers. Fibers such as these are the microfibers mentioned above. In another embodiment of the invention, therefore, the blended yam contains microfibers no more than 10 $\mu$m in diameter.

The natural fiber component of the blended yam may consist of cotton, rayon or any other suitable natural fibers. In one preferred embodiment, the natural fiber component of the blended yarn consists mainly of cotton.

The width of the binding on the bottom of the cover panel may differ according to the particular floor-cleaning requirements. Thus, the binding may differ in width, for example, for thorough cleaning or for maintenance cleaning. In one preferred embodiment of the invention, the binding on the bottom of the substantially rectangular cover panel may have a width of about one fifth to one third the width of the cover panel or mop head.

The textile material of the binding, which according to the invention also performs the function of a textile border, may differ in character. Thus, a binding of fleece, padding or felt may be provided. However, the binding is preferably a woven or knitted flat material. It may be attached to the cover panel in different ways, including bonding for example. It is preferably sewn onto the edge of the cover panel.

The ability of the binding to remove firmly adhering soil from the floor and to retain it in the binding is strengthened if the binding is a velour-like or terry-like flat textile material. Where a velour-like material is used, abrasiveness is increased; where a terry-like material is used, the soil uptake and holding capacity is increased.

In the institutional cleaning of buildings, floors are generally cleaned by the figure-of-eight process in which only one of the two longitudinal sides of the rectangular mop head is always at the front in the wiping direction. Accordingly, with the flat mop head according to the invention, it is sufficient if only one of the two longitudinal sides is provided with the textile border according to the invention. In this case, however, the user must keep the mop head correctly aligned. A completely encircling binding of the type according to the invention, which also serves as a textile border, is therefore of advantage. There is thus no need to check on the position of the mop head in relation to the wiping direction. If the figure-of-eight process is not applied, wiping may also be carried out in the direction of the narrow sides of the mop head.

In another particularly advantageous embodiment, the binding is only provided on the longitudinal sides of the rectangular mop head. In this way, the cover panel with the cleaning-active material on the bottom portion and the binding can be produced as an endless strip which is subsequently cut to the required length of the mop head. Only the narrow sides have to be edged and the means for attachment to a holder put in place. The complicated attachment of the textile border involved in the production of known mop heads with encircling strands, strips or loops is simplified and may readily be automated.

In another preferred embodiment, that part of the binding which lies on the bottom of the cover panel is only indirectly attached to the edge of the cover panel. The inwardly facing edge of the lower binding is thus freely movable. During wiping, the binding lying to the rear in the wiping direction turns over and the now enlarged wiping surface increases the cleaning performance.

In order readily to distinguish between the various cleaning-active zones of the flat mop head according to the invention, namely the textile border or the binding and the middle highly absorbent region of the lower surface, the binding and the absorbent material in the middle of the bottom of the cover panel are differently colored.

BRIEF DESCRIPTION OF THE DRAWINGS

One example of various embodiments of the invention is described in detail in the following with reference to the accompanying drawings, in which like items are identified by the same reference designation, wherein.

Figure 1:
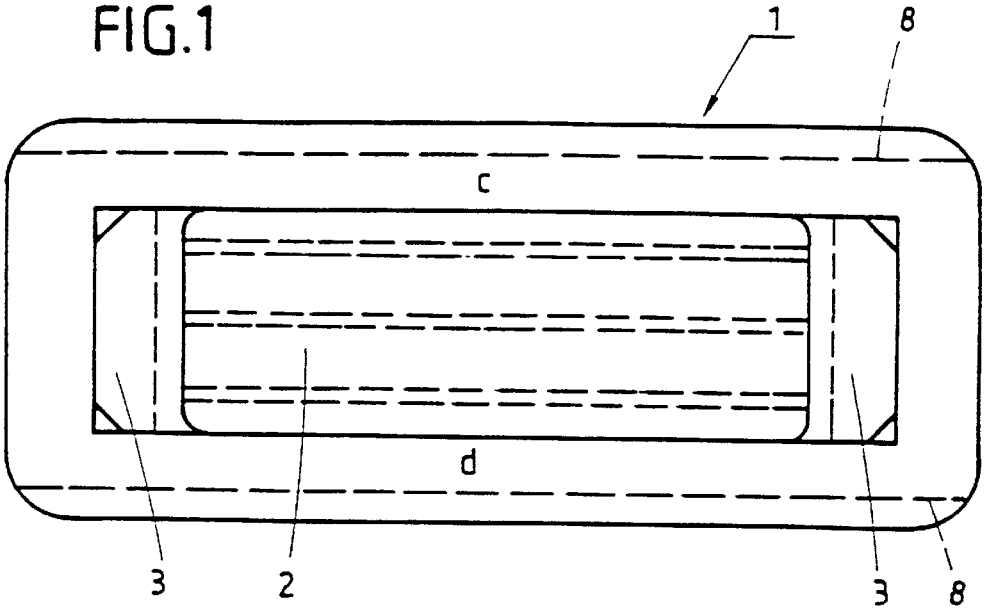
FIG. 1 is a top view of one embodiment of a flat mop head according to the invention.
Figure 2:
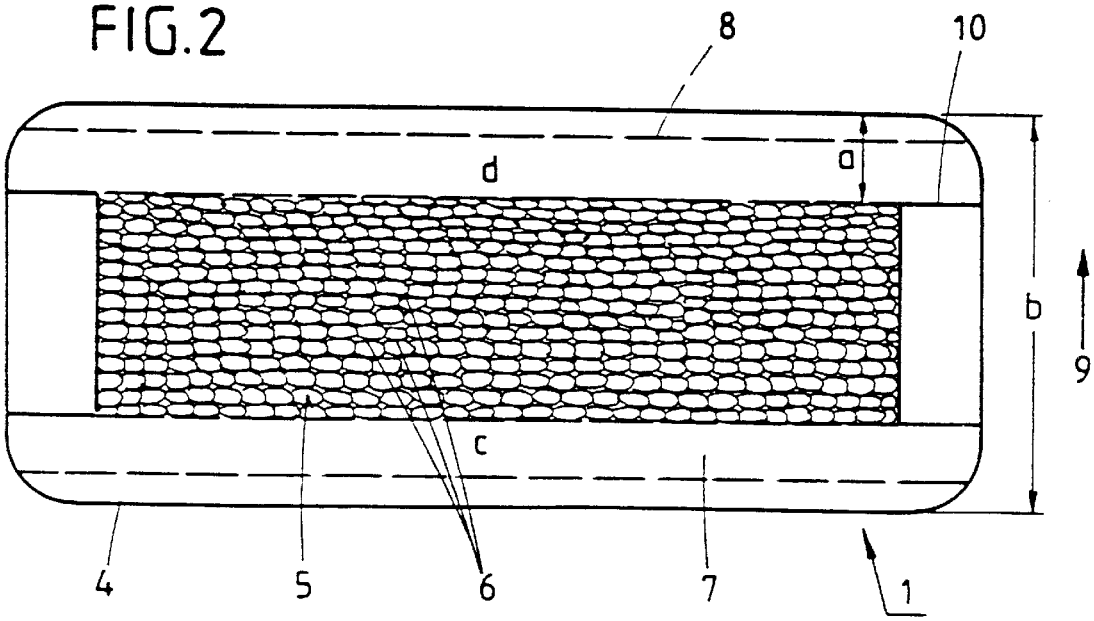
FIG. 2 is a plan view of the bottom of the mop head.

The flat mop head 1 consists of a cover panel 2 with insertion pockets 3 for a holder of a floor mop. The middle region 5 of the bottom portion (FIG. 2) is covered with loops 6 of rayon, cotton or blends of rayon/cotton with synthetic fibers. The synthetic fibers may be of polyester, polyamide or polypropylene. The loops 6 may also partly contain yarns with microfibers. However, the need for high absorbency is important and is only satisfied by rayon or cotton. Alternatively, the middle part of the bottom surface may also be provided with strands, tufts, strips, velour or a flat textile material.

The edges 4 of the rectangular mop head are faced with a terry-like material consisting of a blended yarn of polyester fibers and cotton fibers. This binding 7 is intended both to border the edges and to loosen and retain solid soil particles. The width "a" of the binding 7 on the bottom is between one fifth and one sixth of the width "b" of the cover panel. In contrast to the a beige colored middle portion of the upper and lower faces of the cover panel, the encircling textile border 7 may be blue in color.

The textile border 7 is 3 cm wide. However, the seam 8 is spaced about 0.5 cm from the outer edge so that the edge 10 of the binding 7 arranged on the bottom of the cover panel 2 is freely movable. As a result of this, the two sewn on textile borders c, d differ in their behavior during the cleaning process. During a wiping movement in the direction of arrow 9, the border d is applied flat to the floor while the border d turns over because the seam is only situated in the last 0.5 cm. This lifting from the cover panel and turning over provides for a thorough cleaning effect because the textile border not only slides flat over the floor.

| List of Reference Numerals | |
|---|---|
| 1 | Flat mop head |
| 2 | Cover panel |
| 3 | Insertion pocket |
| 4 | Edge |
| 5 | Middle region |
| 6 | Loops |
| 7, c, d | Textile border, binding |
| a | Width of the binding |
| b | Width of the cover panel |
| 8 | Joining seam between cover panel and textile border (binding) |
| 9 | Arrow |
| 10 | Edge |

Although various embodiments of the invention have been shown and described above, they are not meant to be limiting. Those of skill in the art may recognize certain modifications to these embodiments, which modifications are meant to be covered by the spirit and scope of the appended claims.

What is claimed is:

1. A flat mop head for cleaning floors comprising a cover panel having a length and a width provided on its top surface with means for attachment to a holder and in the middle of its bottom surface with a highly absorbent material consisting at least partly of cotton and/or rayon, the longitudinal sides of the cover panel at least being edged with a binding of a flat textile material and an at least partly encircling textile border being arranged at the edges of the mop head, wherein the textile border is formed by the binding which extends on the bottom surface of the cover panel towards the middle thereof over a distance corresponding to at least one sixth of the width of the cover panel and which consists at least partly of blended yarns of synthetic and natural fibers.

2. A flat mop head as claimed in claim 1, wherein the synthetic fiber component of the blended yarn consists of polyester.

3. A flat mop head as claimed in claim 2, wherein the blended yarn contains microfibers no more than 10 $\mu$m in diameter.

4. A flat mop head as claimed in claim 2, wherein the binding is only provided on the longitudinal sides of the cover panel mop head.

5. A flat mop head as claimed in claim 1, wherein the blended yarn contains microfibers no more than 10 $\mu$m in diameter.

6. A flat mop head as claimed in claim 5, wherein the binding on the bottom of the cover panel has a width (a) of about one fifth to one third the width (b) of the cover panel.

7. A flat mop head as claimed in claim 5, wherein the binding is a woven or knitted flat textile material which is attached to the edge of the cover panel.

8. A flat mop head as claimed in claim 6, wherein the binding is a woven or knitted flat textile material which is attached to the edge of the cover panel.

9. A flat mop head as claimed in claim 1, wherein the natural fiber component of the blended yarn consists mainly of cotton.

10. A flat mop head as claimed in claim 1, wherein the binding on the bottom of the cover panel has a width (a) of about one fifth to one third the width (b) of the cover panel.

11. A flat mop head as claimed in claim 10, wherein the binding is a woven or knitted flat textile material which is attached to the edge of the cover panel.

12. A flat mop head as claimed in claim 10, wherein said binding completely encircles said cover panel.

13. A flat mop head as claimed in claim 10, wherein the binding is only provided on the longitudinal sides of the cover panel.

14. A flat mop head as claimed in claim 1, wherein the binding is a woven or knitted flat textile material which is attached to the edge of the cover panel.

15. A flat mop head as claimed in claim 1, wherein the binding is a velour-like flat textile material.

16. A flat mop head as claimed in claim 1, wherein the binding is a terry-like flat textile material.

17. A flat mop head as claimed in claim 1, wherein said binding completely encircles said cover panel.

18. A flat mop head as claimed in claim 1, wherein the binding is only provided on the longitudinal sides of the cover panel.

19. A flat mop head as claimed in claim 18, wherein that portion of the binding which lies on the bottom surface of the cover panel is only indirectly attached to the edge of the cover panel.

20. A flat mop head as claimed in claim 1, wherein the binding and the absorbent material in the middle of the bottom of the cover panel are differently colored.

* * * * *